United States Patent [19]

Takeuchi

[11] 4,192,130

[45] Mar. 11, 1980

[54] TIME COUNTING CONTROL SYSTEM

[75] Inventor: Eiichi Takeuchi, Iruma, Japan

[73] Assignee: Casio Computer Co., Ltd., Tokyo, Japan

[21] Appl. No.: 855,211

[22] Filed: Nov. 28, 1977

[30] Foreign Application Priority Data

Dec. 1, 1976 [JP] Japan ..... 51/144544

[51] Int. Cl.[2] ..... G04C 3/00

[52] U.S. Cl. ..... 368/155; 364/569; 235/92 T

[58] Field of Search ..... 58/23 R

[56] References Cited

U.S. PATENT DOCUMENTS

| | | | |
|---|---|---|---|
| 4,063,409 | 12/1977 | Bayliss | 58/23 R |
| 4,114,363 | 9/1978 | Imamura | 58/23 R |

OTHER PUBLICATIONS

"Proceedings of the Cambridge Philosophical Society", Science Museum Library, London, 27 Jan. 1953, pp. 230–238.

*Primary Examiner*—S. J. Witkowski

*Attorney, Agent, or Firm*—Frishauf, Holtz, Goodman and Woodward

[57] ABSTRACT

A time counting control system comprises: a timing signal generator for generating at least a read-in clock signal on the basis of a reference clock signal outputted from a reference clock signal oscillator; a microprogram control unit including an address register which is controlled by the read-in clock signal outputted from the timing signal generator, an address section which decodes the contents of the address register and energizes address lines related to a plurality of processing steps, and a microprogram storing section which simultaneously outputs microprogrammed instructions and the address of the instruction to be succeedingly executed; and a count/operation unit which performs a counting operation under the control by instructions successively outputted from the microprogram storing section of the program control unit, includes an arithmetic device and a register connected to said arithmetic means to store counting information and is so controlled as to perform a counting operation each time the microprogram control unit processes the plurality of processing steps.

7 Claims, 24 Drawing Figures

| DIGIT | CODE | | | |
|---|---|---|---|---|
| | 1 | 2 | 4 | 8 |
| $D_1$ | 1 | 0 | 0 | 0 |
| $D_2$ | 0 | 1 | 0 | 0 |
| $D_3$ | 1 | 1 | 0 | 0 |
| $D_4$ | 0 | 0 | 1 | 0 |
| $D_5$ | 1 | 0 | 1 | 0 |
| $D_6$ | 0 | 1 | 1 | 0 |
| $D_7$ | 1 | 1 | 1 | 0 |
| $D_8$ | 0 | 0 | 0 | 1 |
| $D_9$ | 1 | 0 | 0 | 1 |
| $D_{10}$ | 0 | 1 | 0 | 1 |
| $D_{11}$ | 1 | 1 | 0 | 1 |
| $D_{12}$ | 0 | 0 | 1 | 1 |
| $D_1 \sim D_3$ | 1 | 1 | 1 | 1 |

REG CONSTRUCTION

FIG. 5

| INSTRUCTION | ROM OUTPUT | | | | | | |
|---|---|---|---|---|---|---|---|
| | GS | A | $J_1$ | $J_2$ | C | T | K |
| CLEAR | 1 | 0 | 0 | 0 | 0 0 0 0 | PREDETERMINED TIMING | 0 |
| D — CODE | 1 | 1 | 0 | 0 | PREDETERMINED CODE | PREDETERMINED TIMING | 0 |
| D — CODE | 1 | 0 | 0 | 0 | COMPLEMENT CODE | PREDETERMINED TIMING | 0 |
| JUDGEMENT 1 | 0 | 1 | 1 | 0 | PREDETERMINED CODE | PREDETERMINED TIMING | 0 |
| JUDGEMENT 2 | 0 | 0 | 0 | 1 | PREDETERMINED CODE | PREDETERMINED TIMING | 0 |
| KEY IS OPERATED OR NOT | 0 | 0 | 0 | 0 | 0 0 0 0 | 0 0 0 0 | 1 |

PROCESSING TIME
(1 BLOCK 1 WORD)

1 a (2048)
b
2
3
4
5
6
7
8
9
10
1
S11 D1~D3 CLEAR (2)
S12 JUDGEMENT 1
NO
D4/9 (11)
S13
S14 YES
(13) D4-15
D4 CLEAR (12)
4
S15 JUDGEMENT 1
NO
D5/5 (14)
S16
S17 YES
(17) D5-15
D5 CLEAR (16)
6
S18 JUDGEMENT 2
NO
D7/1 (15)
JUDGEMENT 1
S19
S24 YES
NO
D6/9
D1~D3 -1 (18)
S20
S21 YES
S25 JUDGEMENT 1
D6-15
D6 CLEAR
D6/2
NO
9
S22
S28 YES
S26
D1~D3 -1
D7 CLEAR
D6-15
S23
S29
S27
YES
D7-15
D6-1
D6/2
NO
1
F2
AM/PM/ DAY OF WEEK PROCESSING
Xn
X1
TO PREDE-TERMINED STEP OF (1) TO (10)
F3
DAY/MONTH PROCESSING
Y1
Y2
Yn
TO PREDETERMINED STEP OF (1) TO (10)

5:30 SET START

| | $H_1$ | $H_0$ | $MI_1$ | $MI_0$ | $C_2$ | $C_1$ | $C_0$ |
|---|---|---|---|---|---|---|---|
| FIG. 7a | 0 | 5 | 3 | 0 | 0000 | 0000 | 0000 |

10 TH WORD FROM START

| | | | | | | | |
|---|---|---|---|---|---|---|---|
| FIG. 7b | 0 | 5 | 3 | 0 | 1111 | 1111 | 1111 |

(10 X 2048) TH WORD FROM START

| | | | | | | | |
|---|---|---|---|---|---|---|---|
| FIG. 7c | 0 | 5 | 3 | 0 | 0111 | 1111 | 1111 |
| FIG. 7d | 0 | 5 | 3 | 1 | 0000 | 0000 | 0000 |

5:39 → 5:40

| | | | | | | | |
|---|---|---|---|---|---|---|---|
| FIG. 7e | 0 | 5 | 3 | 9 | 0111 | 1111 | 1111 |
| FIG. 7f | 0 | 5 | 4 | 0 | 0000 | 0000 | 0000 |

5:59 → 6:00

| | | | | | | | |
|---|---|---|---|---|---|---|---|
| FIG. 7g | 0 | 5 | 5 | 9 | 0111 | 1111 | 1111 |
| FIG. 7h | 0 | 6 | 0 | 0 | 0000 | 0000 | 0000 |

9:59 → 10:00

| | | | | | | | |
|---|---|---|---|---|---|---|---|
| FIG. 7i | 0 | 9 | 5 | 9 | 0111 | 1111 | 1111 |
| FIG. 7j | 1 | 0 | 0 | 0 | 1111 | 1111 | 1111 |

10:59 → 11:00

| | $H_1$ | $H_0$ | $MI_1$ | $MI_0$ | $C_2$ | $C_1$ | $C_0$ |
|---|---|---|---|---|---|---|---|
| FIG. 7k | 1 | 0 | 5 | 9 | 0111 | 1111 | 1111 |
| FIG. 7ℓ | 1 | 1 | 5 | 9 | 1111 | 1111 | 1111 |

11:59 → 12:00

| | | | | | | | |
|---|---|---|---|---|---|---|---|
| FIG. 7m | 1 | 1 | 5 | 9 | 0111 | 1111 | 1111 |
| FIG. 7n | 1 | 2 | 0 | 0 | 1111 | 1111 | 1111 |

12:59 → 13:00

| | | | | | | | |
|---|---|---|---|---|---|---|---|
| FIG. 7o | 1 | 2 | 5 | 9 | 0111 | 1111 | 1111 |
| FIG. 7p | 0 | 1 | 0 | 0 | 1111 | 1111 | 1111 |

TIME COUNTING CONTROL SYSTEM

BACKGROUND OF THE INVENTION

The present invention relates to a time counting control system in which time counting is carried out on the basis of a reference clock signal and various necessary operations are performed under the control of a controller (for example, a read only memory) storing microprograms. More particularly, the present invention relates to a time counting control system in which the reference clock signal is frequency-divided into a given clock signal through counting of the processing operation for executing a plurality of steps of the microprogram outputted from the controller.

By convention, a time counting control system such as an electronic timepiece is constructed such that a reference oscillator oscillates a reference signal with frequency of $2^n$, for example, $2^{15}=32.768$ KHz, and the reference signal is frequency-divided by a frequency-dividing circuit including multistage flip-flops using semiconductor devices such as CMOS into a signal with 1 second period. Such a system is disclosed in U.S. Pat. No. 3,664,118. However, the conventional time counting control system using multistage flip-flop circuits for the frequency-dividing needs a number of stages of flip-flop circuits, being followed by complexity of circuit construction. U.S. Pat. No. 3,788,058 discloses another type of the electronic timepiece. In this system, a time counting circuit for counting a one second signal to obtain the time information is used together with a circulating shift register for storing the time information such as second, minute, hour, etc., and an arithmetic device for arithmetically processing the time information from the shift register. A display device used properly visualizes the time information stored in the shift register. In the time counting control system that the time information stored in the shift register is arithmetically operated in an arithmetic device and then the time information operated is stored again in the shift register, with display of the time information in a display device, the arithmetic operation and the display operation are controlled, with the view of simplifying the circuit construction, by using a read only memory, for example, having microprogrammed control instructions stored, and related peripheral circuits such as an address register. This control system is known. The processing by the micro-instructions needs given time periods of instruction executions.

Accordingly, an object of the present invention is to provide a novel time counting control system with simple circuit construction and using a microprogram controller, in which the execution times of micro-instructions are processed as counting times and the reference signal is frequency-divided by the execution times.

Another object of the present invention is to provide a novel time counting control system of which the circuit for frequency-dividing a reference signal is simplified, the time counting control system having at least time counting function and a controller for storing key operation signals of a keyboard, display operation signals of a display device, and various operation signals in the forms of micro-instructions and for controlling various operations by using the micro-instructions.

SUMMARY OF THE INVENTION

To achieve these objects, there is provided a time counting control system comprising: a timing signal generating means for generating at least a read-in clock signal on the basis of a reference clock signal outputted from a reference clock signal oscillator; microprogram control means including an address register which is controlled by the read-in clock signal outputted from the timing signal generator means, and address section which decodes the contents of said address register and energizes address lines related to a plurality of processing steps and a microprogram storing section which simultaneously outputs microprogrammed instructions and the address of the instruction to be succeedingly executed, in response to addressing by the address section; and count/operation means which performs a counting operation under control by instructions successively outputted from the microprogram storing section of the microprogram control means, includes an arithmetic means and a register connected to the arithmetic means to store counting information and is so controlled as to perform a counting operation each time the microprogram control means processes the plurality of processing steps.

With such a construction, the time counting control system of the invention eliminates a need of the frequency-dividing circuit constructed by multistage flip-flop circuits. The steps of the microprogram to cause the reference counter to operate each a given time are incorporated into the microprogram, in this invention. Therefore, the time counting control system of the invention is improved in that the circuit construction is simplified, the capacity of the reference counter is very small, and the control unit related to the frequency-dividing is simply constructed by using semiconductor memory device such as ROM.

In the system of the invention, key operation signals of the keyboard, display operation of the display system, and various other operations are controlled by a controller through micro-instructions. For this, the system may be incorporated into a computer system employing such the system, for example, a desk top calculator with time-counting function, making the apparatus small in size.

BRIEF DESCRIPTION OF THE DRAWINGS

FIG. 5 shows the contents of the instructions used in the illustrated embodiment;

FIGS. 7(*a*) to 7(*p*) illustrate the changes of the contents of a clocking register of the illustrated embodiment which results from the clocking operation.

DETAILED DESCRIPTION

Figure 1:
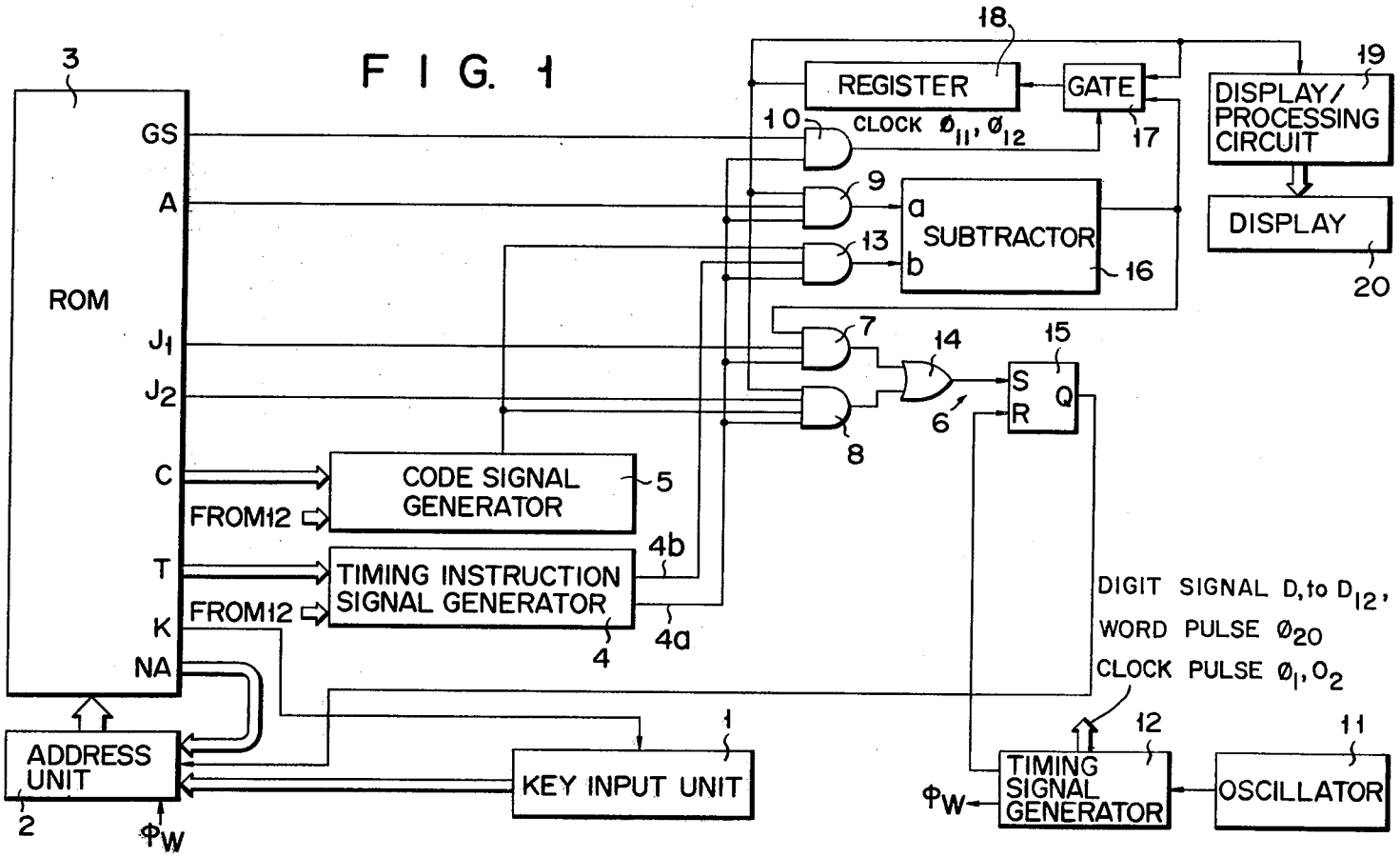
FIG. 1 shows a block diagram of an embodiment of a clocking apparatus according to the present invention.
Figures 2, 3:
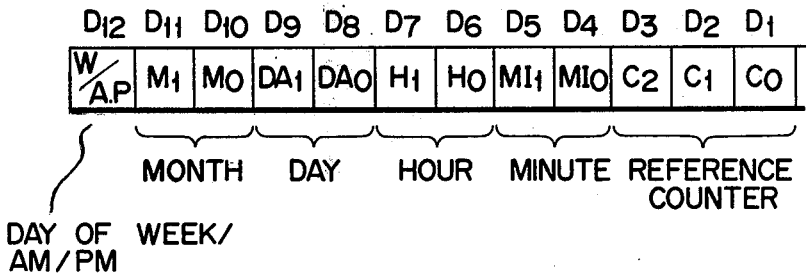
FIG. 2 shows a table tabulating timing signals outputted from the timing signal generator and the corresponding codes output from ROM.
FIG. 3 shows the construction of a clocking register used in the illustrated embodiment.

Referring now to FIG. 1, there is shown a preferred embodiment of a clocking apparatus according to the present invention. In the figure, reference numeral 1 designates a key input unit of which the key actuation output is transferred to an address unit 2. A program control unit, i.e. ROM 3, is addressed by the address unit 2. The ROM 3 stores microprograms to control the timing operation of the clocking apparatus and, in response to addressing by the address unit 2, produces various control signals; next address NA, key input instruction K, timing instruction T, code signal generating instruction C, judgement instructions J1 and J2, operation instruction A, and gate select signal GS. Details of the ROM 3 and the address unit 2 will be referred to later. The next address NA is transferred to the address unit 2; the key input instruction signal K to the key input unit 1; the timing instruction signal T to a timing instruction signal generator 4; the code generating instruction C to a code signal generator 5; the judgement instruction signals J1 and J2 to AND circuits 7 and 8 of a judgement circuit; the operation instruction signal A to an AND circuit 9; the gate select signal GS to an AND circuit 10. Numeral 11 designates an oscillator for oscillating a clock signal of 32.78 KHz, for example, and the output of the oscillator 11 is transferred to a timing signal generator 12. The timing signal generator 12 produces various timing signals such as digit signals D1, D2, . . . D12, as shown in the left column of FIG. 2, bit signals, etc. These timing signals are applied to the timing instruction signal generator 4 and the code signal generator 5. The timing instruction signal generator 4 is provided with output lines 4*a* and 4*b*. One or combination of the digit signals from the timing signal generator 12 (for example, digits D2 to D3 shown in FIG. 2) in accordance with the timing instruction signal T from the ROM 3 shown in the right column of FIG. 2 is outputted by way of the output line 4*a*. One shot signal of one digit is outputted by way of the output line 4*b* in synchronism with the leading edge of the timing signal. The code signal generator 5 produces predetermined code signals in accordance with the contents of the code signal generating instruction signal C from the ROM 3 in synchronism with the timing signal from the timing instruction signal generator 12. The code signal generated by the code signal generator 5 is transferred to AND circuits 8 and 13. The output signal bearing on the output line 4*a* of the timing instruction signal generator 4 is transferred to AND circuits 7 to 10 and 13 and the output signal on the output line 4*b* to the AND circuit 13. The judgement circuit 6 comprises the AND circuits 7 and 8 and a flip-flop 15 to which the outputs of the AND circuits 7 and 8 are applied through an OR circuit 14. The output of the flip-flop 15 is transferred as the output of the judgement circuit 6 to the address unit 2. The flip-flop 15 is reset by the signal from the timing signal generator 12. The outputs of the AND circuits 9 and 13 are coupled with inputs a and b of a subtractor 16. The subtractor 16 subtracts data inputted to the input b from data inputted to another input a. The result of the subtraction is transferred to the AND circuit 7 and to a register 18 via a gate 17. The register 18 is constructed by 12 digits and the contents of the register 18 circulates through the gate 17. The output of the register 18 is transferred to a display processing circuit 19 and to the AND circuits 8 and 9. The display processing circuit 19 is to convert serial data from the register 18 into parallel data and to add breakpoint codes to the transferred data. The output thus display-processed of the display processing circuit 19 is transferred to a display 20 for visual representation.

FIG. 3 shows schematically the construction of the register 18. The register 18 consists of 12 digits specified by digit signals D1 to D12, for example, each digit consisting of four bits. Three digits specified by the digit signals D1 to D3 form a reference counter C0, C1 and C2 which executes a count operation of "2048" with three digits (12 bits). Digits MI0 and MI1 specified by digit signals D4 to D5 are used to count chronological minute information; digit MI0 counts "minute" unit and digit MI1 "minutes" unit. Digit H0 and H1 specified by digit signals D7 and D6 counts hour information; H0 counts "hour" unit and H1 "ten hours" unit. Digits DA0 and DA1 by digit signals D8 and D9 counts day information; DA0 count "day" unit and DA1 "ten days" unit. Digit signals D10 and D11 specifies digits M0 and M1 which counts month information. Digit M0 counts "month" unit and digit M1 "ten months" unit. Digit signal D12 specified digit W/A.P which signifies a day of week and a.m. or p.m. The first bit of the digit signifies a.m. or p.m. and the 2nd to 4th bits count a day of week.

Figure 4:
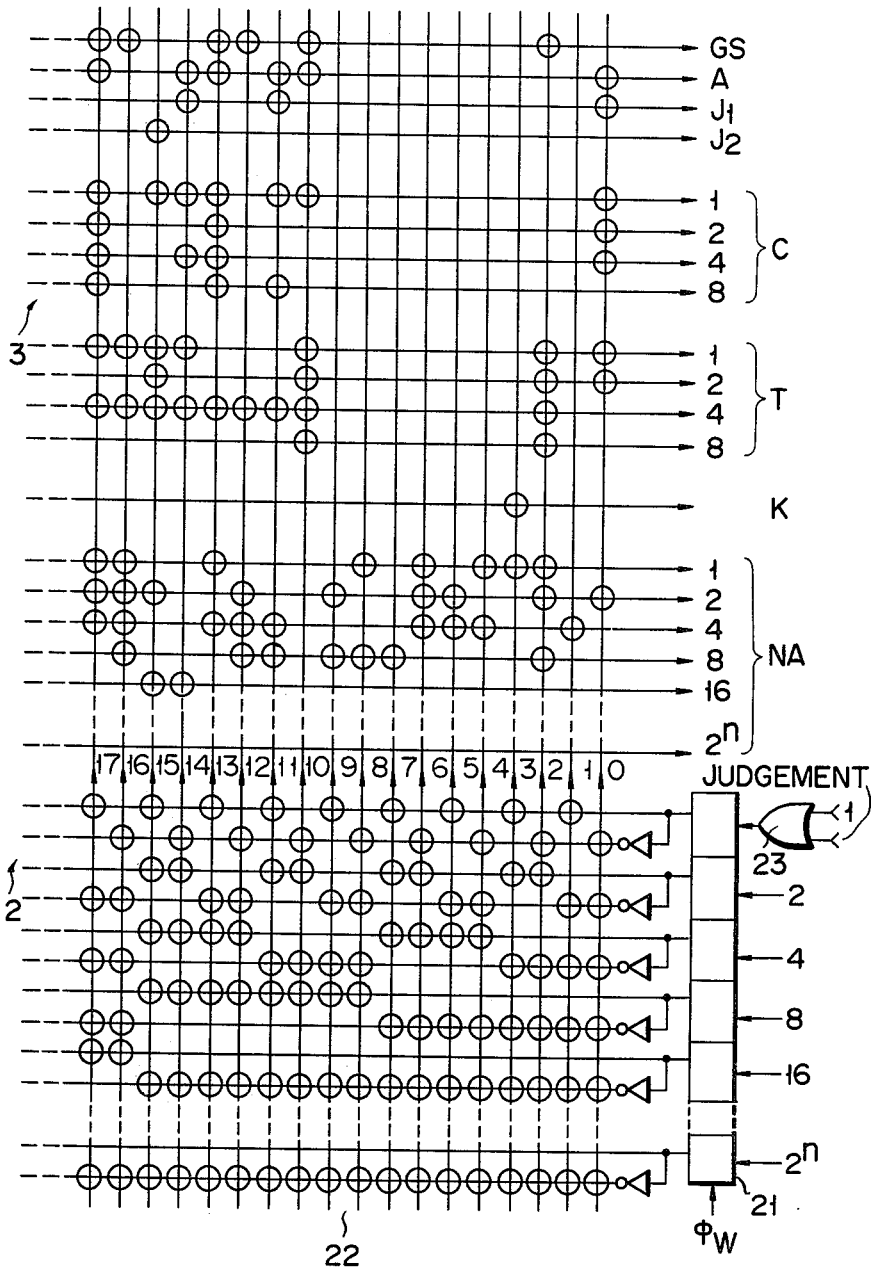
FIG. 4 shows details of the ROM (control unit) and an address unit used in the illustrated embodiment.

FIG. 4 illustrates details of the address unit 2 and the ROM 3 shown in FIG. 1. The address unit 2 includes an address register 21 for temporarily storing address data given from the key input unit 1, the judgement circuit 6 or ROM 3 and a decoder 22 for decoding codes incoming directly and by way of inverters from the address registers 21 to address the ROM 3. The first bit of the address register 21 receives the first bit of the address data inputted and a judgement signal from the judgement circuit 6, through an OR circuit 23. The judgement signal from the judgement circuit 6 is "0" for YES and "1" for NO. The address data to be inputted to the address unit 2 is weighted by 1-2-4-8 code to take a form of "$2^0 \ldots 2^n$". In synchronism with the word pulse $\phi_w$ fed from the timing signal generator 12, the address unit 2 loads the input data into the address register 21 and addresses the ROM 2 in accordance with the data. The address unit 2 and ROM 3 illustrated in FIG. 4 are constructed relating to 0 to 17 addresses. The ROM 3 produces signals mentioned above in accordance with the addressing from the address unit. The next address NA is produced as a code "$2^0 \ldots 2^n$" and the key input instruction K is produced when the third address is specified. The timing instruction T and the code signal generating instruction C are outputted in the form of 4 bits code in response to addressing. The judgement instructions J1 and J2, the operation A and the gate select signal GS are outputted in the form of one bit and transferred to the specified circuits, respectively.

Referring to FIG. 5, there is tabulated examples of the instructions used in the present invention and their related outputs of the ROM 3. The instructions tabulated are as follows: CLEAR instruction of the register 18; D-code instruction when a predetermined code is subtracted from the specified digit D of the register 18; D←code instruction for loading a predetermined code into a predetermined digit of the register 18; JUDGEMENT instruction 1 for judging the result of subtraction from the subtractor 16; JUDGEMENT instruction 2 for judging coincidence between the contents of the register 18 and given bits outputted from the code signal generator 5; JUDGEMENT OF KEY OPERATION OR NOT instruction for judging whether keys are operated or not, from input signal coming from the key input unit 1.

The explanation to follow is the operation of the thus constructed time piece according to the present invention. The oscillator 11 generates a reference signal of 32.768 KHz to be directed to the timing signal generator 12. The timing signal generator 12 produces the digit signals D1 to D12, word pulses $\phi_w$, and reference clock pulses $\phi_1$ and $\phi_2$. The reference clock pulses $\phi_1$ and $\phi_2$ are generated alternately in each cycle of the reference signal. Therefore, the frequency of the clock pulses is $(32.768\times10^3)/2$ Hz. The shift operation of the register 18 is controlled by the clock pulses $\phi_1$ and $\phi_2$. The clock pulses $\phi_1$ are used to control the read-in of data and the clock pulses $\phi_2$ to control the read-out of data. For counting one minute by using the clock pulses $\phi_1$ and $\phi_2$ with the frequency of $32.768\times10^3/2$ Hz, the frequency must be multiplied by 60, i.e. $(32.768\times10^3/2)\times60$. The equation may be changed below:

$$
\begin{aligned}
&(32.768 \times 10^3/2) \times 60\\
&= 2^{15}/2 \times 60\\
&= 2^{14} \times 60\\
&= 2^{11} \times 2^3 \times 60\\
&= 2^{11} \times 8 \times 6 \times 10\\
&= 2^{11} \times 48 \times 10
\end{aligned}
$$

In the above equation, $2^{11}$ is 2048 and this may be counted by a 12-bit counter. As seen from the equation, to effect one minute counting, the counter must be constructed by 12 bits when the bit number of one word is 48, and the counting operation is made once each 10 words. It is for this reason that the register 18 is constructed by 48 bits for one word and the reference counter is constructed with three digits C0 to C2 totally consisting of 12 bits so as to be able to count "2048". The word construction of the register 18 is detailed in FIG. 3.

Figures 6A, 6B:
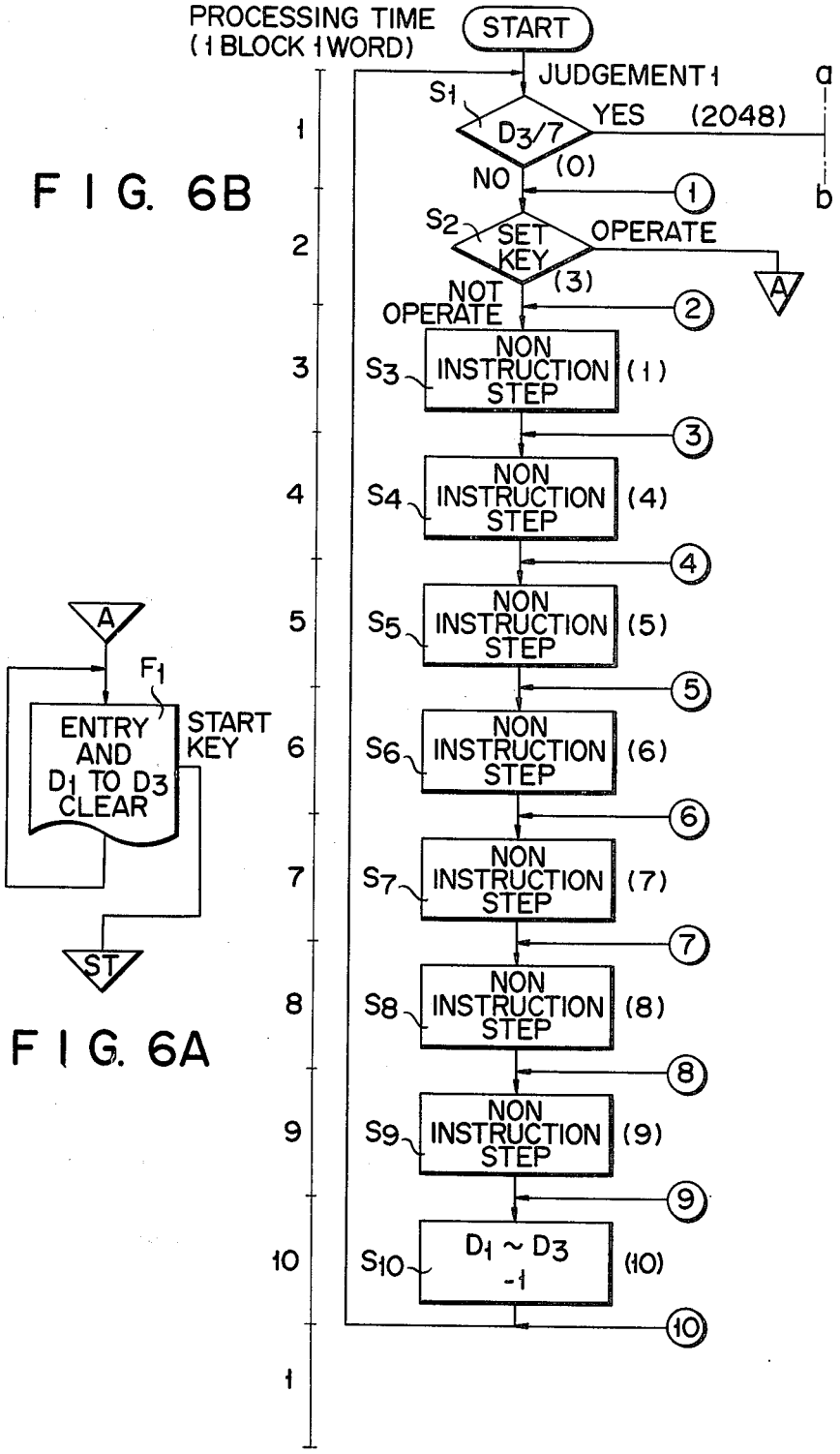
FIGS. 6(A), 6(*b*) and 6(*c*) show flowcharts illustrating the operation of the illustrated embodiment.
Figure 6C:
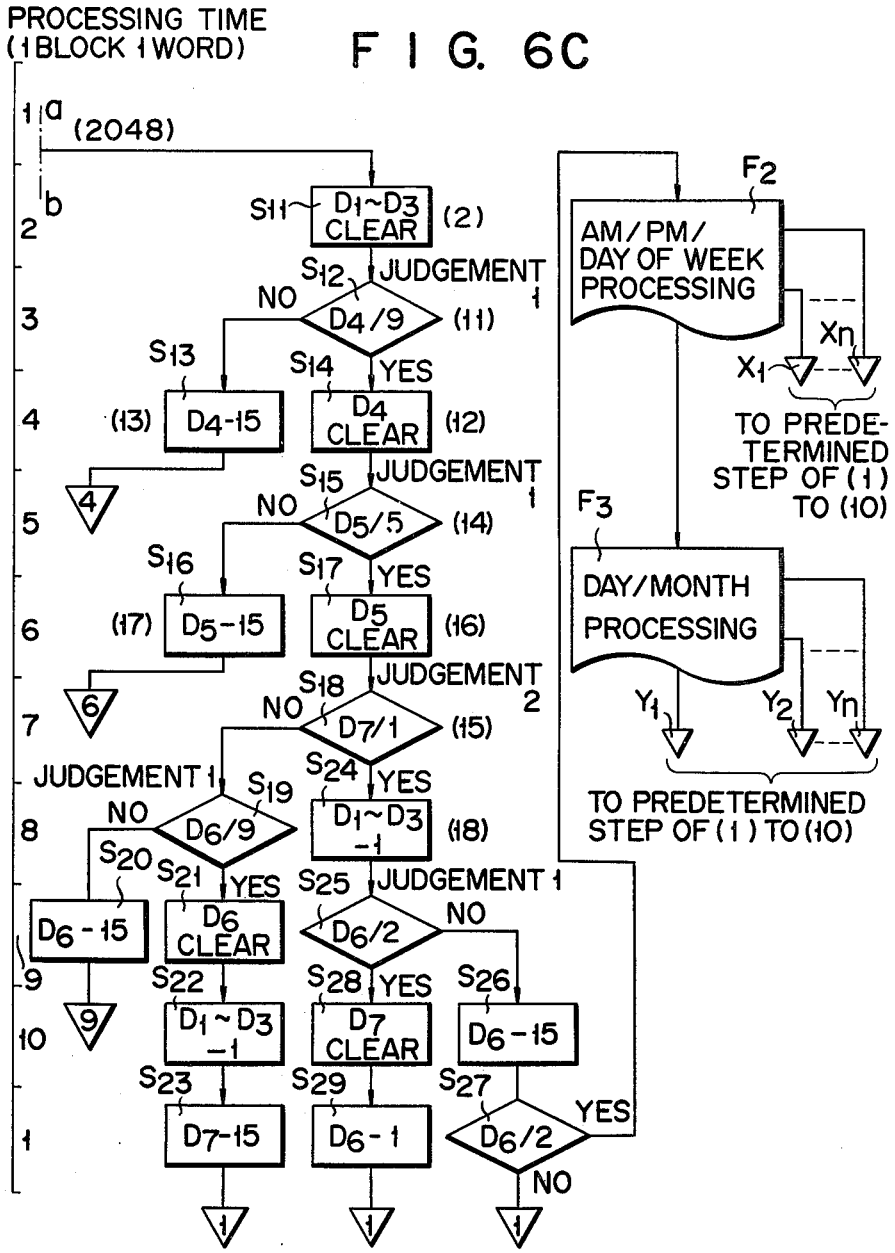
Figure 1:
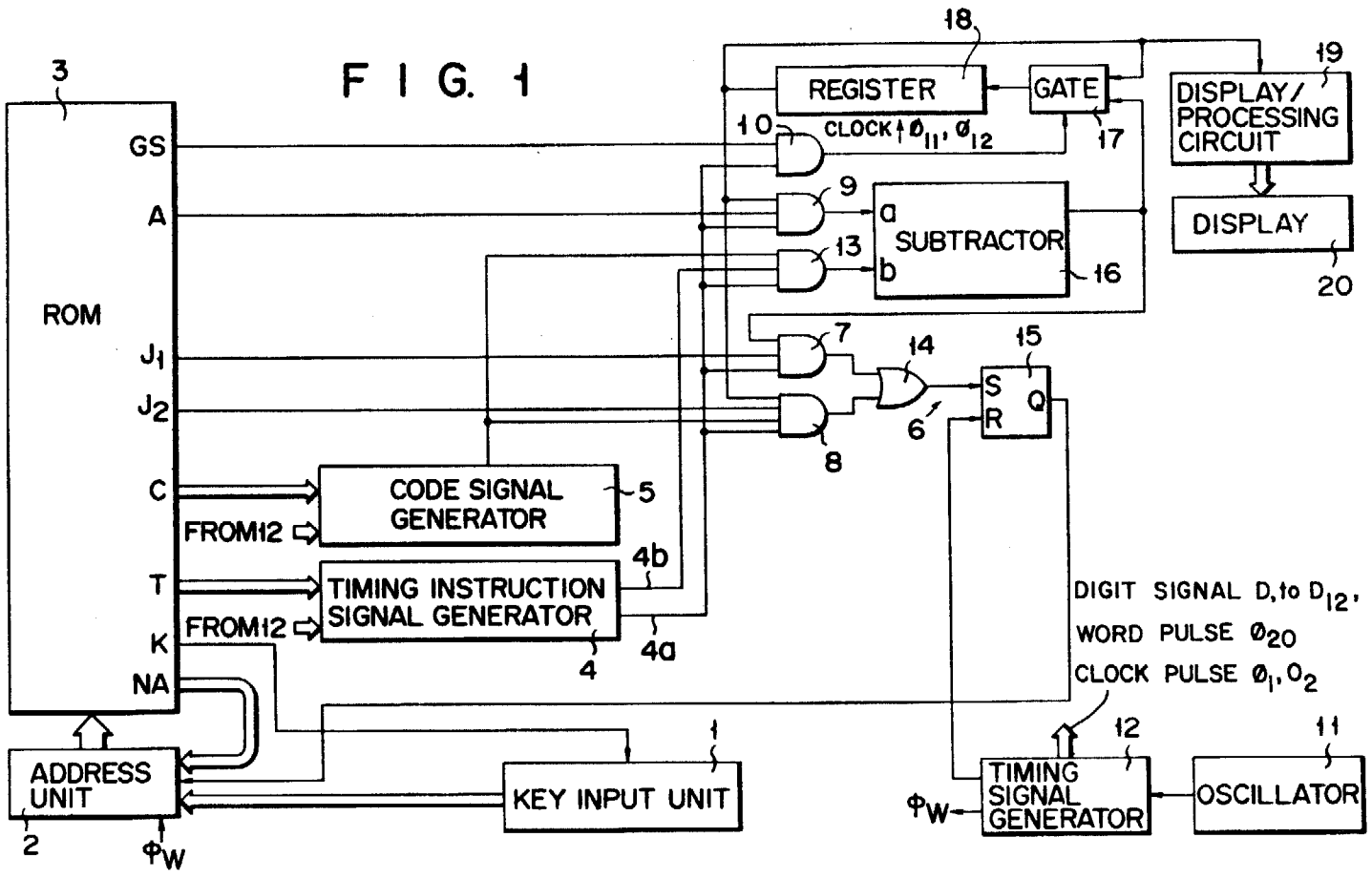

The operation of the register 18 will be described with reference to the flowcharts shown in FIGS. 6(A), (6(B) and 6(C),. In FIG. 6(B), numerals indicated in parenthesises () indicate the address of each step of the flowchart and the next address is shown in FIG. 4. Firstly, time is set through key operation and the operation of the time set key. In response to the key operation, the ROM 3 outputs at the output (not shown) data corresponding to the key operation to be set in a given digit of the register 18. Entry to the key input unit 1 is performed when the ROM 3 outputs the key input instruction K and the set key is operated. That is, when the key input instruction K is outputted from the ROM 3, it is judged whether the set key is operated or not in the key input unit 1. If the set is operated, the flow of F1 of FIG. 6(A) is performed, i.e. the reference counter C0 to C2 specified by digit signals D1 to D3 is cleared. For a clear operation, upon receipt of the CLEAR instruction shown in FIG. 5, the ROM 3 outputs the gate select signal GS and the timing instruction T specified by the digit signals D1 to D3. The gate circuit 17 is switched to the subtractor 16 side. Then, the register 18 is cleared. The gate circuit 17 so operates that, when the output of the AND circuit 10 is "0", i.e. in a normal condition, the contents of the register 18 is permitted to circulate and, when the AND circuit 10 outputs "1", the circulation of the register 18 is ceased and the output of the subtractor 16 is loaded into the register 18. When CLEAR instruction is produced, the AND gates 9 and 13 produce no output, the subtractor 16 produces "0" and "all 0" is loaded into the reference counter C0 to C2. FIG. 7(*a*) shows the contents of the register 18 when time data "5:30" is registered in the register 18 at the F1 flow. The time data is set in the register and at the time that the set time and the present time are coincident, the start key (not shown) in the key input unit 1 is operated to initiate the clocking operation. When the start key is depressed, 0 address of the ROM 3 is specified and the ROM 3 produces JUDGEMENT I instruction. In this instruction, whether the contents of the register 18 is 7, i.e. 0111 in 8-4-2-1 code, or not is judged, as shown in step S1. In the judgement, the ROM 3 produces the instruction at the address 0, code signal, timing signal, etc. with the result that the signal generator 5 produces a serial code of 7 and the timing instruction signal generator 4 produces the digit signal D3. Succeedingly, the subtractor 16 subtracts 7 from the contents of D3 in the clock register 18. The result of the subtraction is transferred through the AND circuits 7 and 14 to the flip-flop 15. As will be recalled, the contents of the reference counters C0 to C2 is cleared at the beginning. Accordingly, subtraction operation "0–7" is performed in the subtractor 16 and the result of the subtraction sets the flip-flop 15. The step S1 judges to provide NO so that the output of the judgement circuit 6 produces "1" which in turn is transferred to the OR circuit 23 of the address unit 2. Although the next address specified by 0 address of the ROM 3 is the second address as shown in FIG. 4, the result of the judgement is NO to feed "1" to the first bit of the address through the OR circuit 23 and therefore the next address is the 3rd address to advance to the step S2 in FIG. 6B. As described above, the step S2 is to judge whether the set key in the key input unit 1 is operated or not. If the set key is operated, a signal coming from the key input unit 1 modifies the address to advance to the flow F1. If it is not operated, the next address specifies the 1st address to advance to step S3. The steps from S3 to S9 are of no instruction step without specified operation; however, the next address NA is continuously specified, as shown in FIG. 4. Therefore, these no instruction steps S3 to S9 each require the processing time of one word, like other steps. Step S9 specifies the next address to progress to step S10. In the step S10, the 10th address is specified. Accordingly, as shown in FIG. 4, the ROM 3 produces the gate select signal GS, the operation instruction A, the code generating instruction C of "1", and the timing instruction T of D1 to D3. Accordingly, the AND circuits 9 and 10 are enabled and the code signal generator 5 and the timing signal generator 4 are both driven. And the subtractor 16 performs a subtraction "D1 to D3-1" so that "1" is subtracted from the reference counter C0 to C2. Since the contents of the reference counter C0 to C2 is all "0", the subtraction of "−1" changes the contents of the reference counter C0 to C2 to all "1", as shown in FIG. 7(*b*). After the step S10 is completed, the execution step returns to the step S1 since the next address of the step S10 is 0 address. A successive operation of S1 to S10 will be cyclically repeated and at the step S10, "1" is subtracted from the contents of the reference counter C0 to C2, as just mentioned. In other words, "1" is subtracted from the contents of the reference counter C0 to C2 each ten words. After the subtraction "−1" is performed 2048 times, the contents of the reference counter C0 to C2 becomes such that the most significant bit is "0" and other bits are all "1", as shown in FIG. 7(*c*). The judgement as to whether the contents of D3 is 7 or not in the stop S1 is YES. In other words, the judgement of the step S1 after the $(10\times2048)$th word from start is YES to advance to step S11. More precisely, when the judgement of the step S1 is YES, the flip-flop 15 of the judgement circuit 6 is not set and only the next address NA of the step S1 (0 address) is applied to the OR circuit 23 of the address circuit 23. Accordingly, the 2nd address of the ROM 3 is specified to advance to the step S11. In the step S11, as in the previous case, the ROM 3 produces the gate select signal GS, the timing signal T for specifying D1 to D3, and the next address NA to specify the 11th address. And the AND gate 10 produces "1" during the timing D1 to D3. Accordingly, the output ("0") of the subtractor 16 is loaded into the clocking register 18 so that the register 18 is placed in "D1 to D3 CLEAR" condition, i.e. it is cleared. The step S11 completes to shift to the step S12 at the 11th address specified by the next address NA where the next address of the 12th address is specified and it is judged whether the contents of the digit D4 of the register 18 is "9" or not. In more particular, the ROM 3 produces from the 11 the address the operation address A and the judgement instruction J1 so that the AND gates 9 and 7 are enabled. The same address of the ROM 3 produces the code generation instruction of "9" and the timing instruction T corresponding to the digit signal "D4". As a consequence, the code signal generator 5 produces the code "9" and the timing instruction T corresponding to "D4" is produced through the output line 4*a* of the timing signal generator 4. Accordingly, the fourth digit (MI0) of the register 18 and the code "9" are applied to the subtractor 16 through the AND circuits 9 and 13, so that the subtractor 16 subtracts "9" from the fourth digit contents of the register 18. The result of the subtraction is applied to the set terminal of the flip-flop through the AND gate 7 and the OR gate 14. In this case, since the contents of the D4 digit is "0", the judgement of the step S12 is NO, and the flip-flop 15 is set so that the execution step advances to step S13. In the step S13, "D4–15", i.e. subtraction of "15" from the "minute" unit of MI0, is carried out. More particularly, the ROM 3 produces from the 13th address the gate select signal GS, the operation instruction signal A, the code generating instruction C of "15",the timing instruction T of "D4" and the next address NA of "5". In the subtractor 16, the code "15", inputted through the AND circuit 13 is subtracted from the "D4" digit inputted through the AND circuit 13. The result of the subtraction is loaded into the register 18 through the gate circuit 17 which has been switched to the subtractor side by the output of the gate circuit 10. Through the subtraction operation, "1" is substantially added to the contents of the register 18 so that the contents of the register 18 becomes as shown in FIG. 7(*d*). When the step S13 is completed, it advances to the no instruction step S5 at the address 5th, considering the processing time of the steps S11 to S13 and passes the steps S6 to S10 to return to the step S1. As in the previous case, a succession of the steps from S1 to S13 is executed 2048 times. In this manner, one minute is clocked through the steps of "10×2048" words and, in the step S13, "1" is successively added to the "minute" digit of MI0, i.e. the digit D4 of the clocking register 18. Thus, the contents of the register 18 becomes "5:39" as shown in FIG. 7(*e*). Through successing clocking operation, the step progresses from S1 to S12, through S11. The judgement as to whether the contents of the digit D4 is 9 or not is performed as in the previous case. Storing of "9" in the digit D4 does not set the flip-flop 15 so that the judgement is YES. Accordingly, only the next address NA from the ROM 3 is applied to the OR circuit 23. The execution step advances to the step S14 at the 12th address and the digit D4 of the register 18 is cleared. Then, it advances to the step S15 causing the ROM 3 to produce from the 16th address the next address NA. In this step, it is judged whether the contents of the digit "D5", i.e. the digit MI1 of "ten minutes" unit, reaches "5" or not. At this time, the contents of the digit D5 is "3" so that the judgement of the step S15 is NO and the output of the flip-flop set is applied to the OR circuit 23 to the address unit 2. As a result, the address is changed to the 17th and the step is advanced to the step S16. In this step, the subtraction "D5–15" is performed and this operation adds substantially "1" to the digit D5 as shown in FIG. 7(*f*). After completion of the step S16, it returns to the step S7 to perform the clocking operation of "minute".

Further, when the contents of the register 18 changes from "5:30" to "6:00", as shown in FIGS. 7(*g*) and 7(*h*), the judgement of the step S15 is YES and the flip-flop 15 is not set, as shown in FIG. 7(*h*). The execution step goes to the step S17 at the address 16 specified in the step S15 to clear the contents of the digit D5 of the register 18. Then, it goes to the step S18 to query if the contents of the digit D7 is "1" or not. The judgement causes the ROM 3 to produce the judgement instruction J2, the code generating instruction C of "1", the timing instruction T of "D7", and the next address NA of "18". The D7 digit of the register 18, i.e. H1, and the output "1" of the code signal generator 5 are applied to the flip-flop 15 through the AND circuit 8 and the OR circuit 14, where coincidence between them is detected. At this time, the contents of the digit D7 is "0" and therefore the judgement in the step S18 is NO. And the execution step goes to the step S19 to check if the contents of the digit D9 is "9" or not. The checking is made simultaneously with the step S12. The result of the check is NO and the step shifts to the step S20 where the subtraction "D6–15" is performed. As a result, "1" is substantially added to the digit D6 so that the contents of the register 18 becomes "6:00". Then, it returns to the step S10.

As shown in FIGS. 7(*i*) and 7(*j*), the contents of the register 18 changed from "9:59" to "10:00". In this case, the contents of the digit D6 has been "9" so that the judgement of the step S19 is YES and the step shifts to the step S21 to clear the digit D6. Then, the step progresses to the step S22 where the subtraction "D1 to D3-1" is carried out. At this time, the digits D1 to D3 were cleared in the step S11 and thus the contents of D1 to D3 becomes all "1", as shown in FIG. 7(*i*), through "−1" operation in the step S22. Then, execution steps forward to the step S23 where the subtraction "D7–15" adds substantially "1" to the digit D7 and then it returns back to the step S2.

When the contents of the register 18 changes from "10:59" to "11:00", as shown in FIGS. 7(*k*) and 7(*l*), the contents of the digit H1 of the "ten hours" unit specified by the digit signal D7 becomes "1" so that the judgement of the step S18 is YES. Execution advances to the step S24 where the subtraction "D1 to D3-1" is carried out. As a result, the contents of the reference counter C0 to C2, i.e. the digits D1 to D3 are all "1", as shown in FIG. 7(1). In the step S25 following the step S24, it is checked to see if the contents of the digit D6 is "2". In this case, the contents of the D6 is "0" and the judgement at the step S25 is NO and thus the execution steps forward to the step S26. In this step, the subtraction "D6–15" adds substantially "1" to the register 18 so that the contents of the register is "11:00". Then, the step is shifted to the succeeding step S27. The step S27 judges again to see if the contents of the digit D6 is 2 or not. At this time, the contents of the digit D6 is "1" so that the judgement is NO. And the step returns back to the step S2.

When the contents of the register 18 is changed from "11:59" to "12:00", as shown in FIGS. 7(*m*) and 7(*n*), the step advances from the step S18 to S24, S25 and S26 for clocking operation, as in the case of change from "10:59" to "11:00". Through this clocking operation, the contents of the register 18 becomes "12:00" and the contents of D6 becomes "2". For this, the judgment at the step S27 becomes the judgement of the step S27 is YES and the execution enters into the flow F2 for processing of A.M/P.M. and day of week and returns to any one of the steps S1 to S10, dependent on the processing time. Then, it advances to the flow F3 for day and month processing after proper processing in the flow F2, with consideration of step number. The execution retnrus back to any one of the steps S1 to S10, dependent on the processing time. Although the flows F1 to F3 will not be referred in detail, proper processings are performed as shown in the above-mentioned clocking operation.

Further, the contents of the register 18 is changed from "12:59" to "1:00", as shown in FIG. 7(*o*) to 7(*p*). In this case, the digit D6 is "2" and the judgement of the step S25 is YES and the step advances to the step S28, to clear the digit D7, as shown in FIG. 7(*p*). Then, the step advances to the succeeding step S29 where "1" is subtracted from "2" of the contents of the digit D6 places the contents of the register 18 to be "1:00". Then, the step returns back to the step S2.

In the drawing of FIG. 7(*b*), address numbers are attached to the steps from S1 to S18 and S24, respectively, and the details of the ROM 3 are illustrated in FIG. 4. The similar construction of the ROM 3 is correspondingly applicable for other steps, and the output conditions of the ROM shown in FIG. 5 are properly selected on the basis of the processing contents of the steps. As described above, even if the flow to be executed is any one of the flows, each 10 words processing is necessarily accompanied by one time of the step "D1 to D3-1", i.e. any one of the specified steps provided in the steps S10, S22, S24 and the flows F2 and F3, thereby to perform the count operation of the reference counter C0 to C2. In other words, the reference counter C0 to C2 does not directly count the reference clock outputted from the oscillator 11 but executes one count operation during the processing time of 10 words, in accordance with the program. The result is that the count period is considerably long and its object may be attained with a small capacity, with considerable simplification of the hardward related.

In the above-mentioned example, the subtractor 16 is used to perform the clocking operation; however, the adder may be substituted for the subtractor, as a matter of course.

The above description refers to only the "minute" unit but it correspondingly is applicable for the "second " unit clocking operation.

Further, one time of the subtraction "D1 to D3-1" is inserted in the processing time of the 10 words, and the "+1" operation is performed. However, in case where there is no branch by the judgement during the processing time of more than 20 words, "+2" operation may be executed by a single step. The "+1" operation may be substituted by "+n" , depending on the processing condition of the steps, reducing step number by and large.

Various other modifications of the disclosed embodiment will be apparent to person skilled in the art without departing from the spirit and scope of the invention as defined by the appended claims.

What is claimed is:

1. A time counting control system comprising:

a reference oscillator for generating reference clock signals having a reference frequency;

timing signal generating means coupled to said reference oscillator for generating at least a read-in clock signal on the basis of a reference clock signal delivered from said reference oscillator;

microprogrammed control means including:

an address register coupled to said timing signal generating means and whose read-in operation is controlled by said read-in clock signals received from said timing signal generating means;

an address section coupled to said address register; and a microprogram storing section coupled to said address section for storing microprogrammed micro-instructions and delivering a micro-instruction from an address which has been designated by said address section, said microinstructions being successively executed to achieve at least a time-counting operation; and a count/operation means including:

an arithmetic operation unit coupled to said microprogrammed control means for carrying out an arithmetic operation every time said microprogrammed control means delivers a predetermined number of micro-instructions; and a register coupled to said arithmetic operation unit for storing time-counting information and which is controlled by said delivered micro-instructions.

2. A time counting control system according to claim 1, in which said timing signal generating means, said microprogram control means and at least a part of said register constitute means for frequency-dividing said reference clock signal.

3. A time counting control system according to claim 1, in which the total number of bits which is the memory capacity of said register is a multiple of 3 and said register performs a counting operation each one minute time interval.

4. A time counting control system according to claim 1, in which said arithmetic operation unit comprises a subtractor.

5. A time counting control system according to claim 1, wherein said microprogrammed control means includes means for storing a micro-instruction and means for comparing a digit of the contents of said register with a data of specific value and means coupled to said comparing means for branching micro-instructions according to the result of said comparison and to be successively executed for carrying out a prescribed time-counting operation, thereby executing data processings of different routines, said microprogram control means and at least a part of said register comprising means for dividing the frequency of said reference clock signals.

6. A time counting control system according to claim 5, wherein said microprogrammed control means includes means for executing said micro-instructions at regular time intervals and for storing micro-instructions which do not control said count/operation means, so as to cooperate with said register to always divide the frequency of said reference clock signals with the same dividing ratio.

7. A time counting control system according to claim 1, further comprising a key input unit coupled to said address register for presetting time-counting information in said address register to thereby start a time-counting operation; and said address section includes means for designating the address of said microprogram storing section according to address data supplied to said address register.

* * * * *

UNITED STATES PATENT AND TRADEMARK OFFICE

CERTIFICATE OF CORRECTION

PATENT NO. : 4,192,130

DATED : March 11, 1980

INVENTOR(S) : Eiichi Takeuchi

It is certified that error appears in the above—identified patent and that said Letters Patent is hereby corrected as shown below:

Sheet 1 of the drawings should be deleted to insert the attached sheet therefor.

Signed and Sealed this

*Twenty-ninth* Day of *July 1980*

[SEAL]

*Attest:*

SIDNEY A. DIAMOND

*Attesting Officer*

*Commissioner of Patents and Trademarks*